US012310398B2

(12) United States Patent
Cantieri et al.

(10) Patent No.: US 12,310,398 B2
(45) Date of Patent: May 27, 2025

(54) METHOD AND APPARATUS FOR SHAPING A CONTINUOUS WEB MATERIAL INTO A ROD

(71) Applicant: PHILIP MORRIS PRODUCTS S.A., Neuchatel (CH)

(72) Inventors: Fabio Cantieri, Bologna (IT); Antonella Giannini, Bologna (IT); Pietro Davide La Porta, Bologna (IT); Stefano Malossi, Bologna (IT); Alberto Monzoni, Bologna (IT); Ivan Prestia, Calderara de Reno (IT); Cristian Castaldo, Bologna (IT); Genny Paladino, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 469 days.

(21) Appl. No.: 17/767,137

(22) PCT Filed: Oct. 8, 2020

(86) PCT No.: PCT/EP2020/078194
§ 371 (c)(1),
(2) Date: Apr. 7, 2022

(87) PCT Pub. No.: WO2021/069534
PCT Pub. Date: Apr. 15, 2021

(65) Prior Publication Data

US 2022/0369694 A1 Nov. 24, 2022

(30) Foreign Application Priority Data

Oct. 9, 2019 (EP) ..... 19202138

(51) Int. Cl.
*A24C 5/18* (2006.01)
*A24B 15/167* (2020.01)
(Continued)

(52) U.S. Cl.
CPC ..... *A24C 5/1864* (2013.01); *A24B 15/167* (2016.11); *A24C 5/01* (2020.01); *A24C 5/1807* (2013.01); *A24C 5/24* (2013.01)

(58) Field of Classification Search
None
See application file for complete search history.

(56) References Cited

U.S. PATENT DOCUMENTS 4,216,706 A 8/1980 Byrne
4,724,429 A 2/1988 Millen
(Continued)

FOREIGN PATENT DOCUMENTS

EP 3232828 2/2000
EP 3328221 6/2018
(Continued)

OTHER PUBLICATIONS

PCT Search Report and Written Opinion for PCT/EP2020/078194 dated Nov. 10, 2020 (12 pages).

*Primary Examiner* — Philip Y Louie
*Assistant Examiner* — Jeffrey A. Buckman
(74) *Attorney, Agent, or Firm* — Mueting Raasch Group

(57) ABSTRACT

The method for shaping a continuous web material (1) into a rod comprises providing a continuous web material (1) having a glass transition temperature below 150 degree Celsius and gathering the continuous web material (1) from a flat shape into a rod-shape by means of a shaping device (2). The method further comprises providing a cooling means (34) providing a temperature below four degree Celsius, cooling a material contact surface of the shaping device (2) to a surface temperature below four degree Celsius, and cooling the continuous gathered web material by the cooled material contact surface in contact with the
(Continued)

Figure 1:
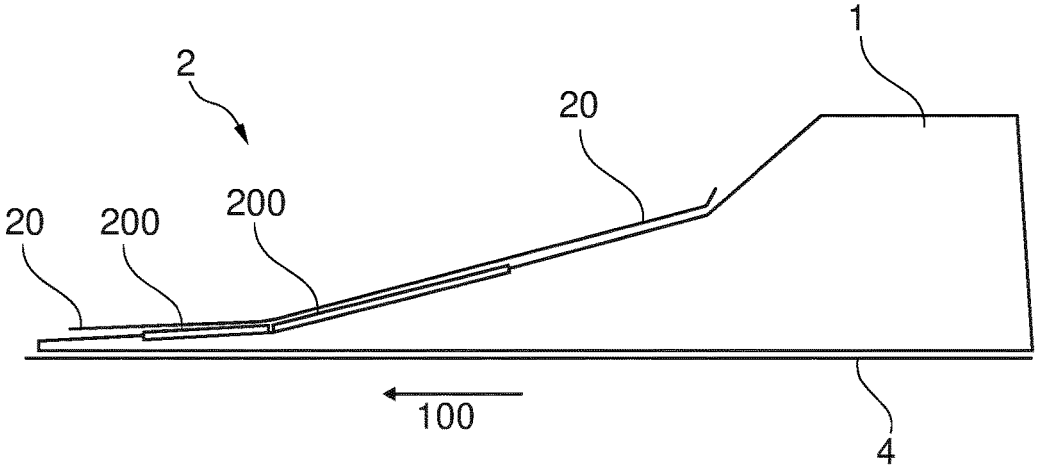

continuous gathered web material. Also provided is an apparatus for shaping a continuous web material (1).

15 Claims, 2 Drawing Sheets

(51) Int. Cl.
*A24C 5/01* (2020.01)
*A24C 5/24* (2006.01)

(56) References Cited

U.S. PATENT DOCUMENTS

| | | | | |
|---|---|---|---|---|
| 7,300,394 | B2 | 11/2007 | Buhl | |
| 2005/0109352 | A1* | 5/2005 | Hartmann | A24C 5/1807 131/84.1 |
| 2017/0332695 | A1* | 11/2017 | Zappoli | A24D 3/0233 |

FOREIGN PATENT DOCUMENTS

| | | |
|---|---|---|
| GB | 1282173 | 7/1972 |
| WO | WO 2016/097016 | 6/2016 |
| WO | WO 2017/021347 | 2/2017 |
| WO | WO 2018/210982 | 11/2018 |
| WO | WO 2019/158313 | 8/2019 |

* cited by examiner

METHOD AND APPARATUS FOR SHAPING A CONTINUOUS WEB MATERIAL INTO A ROD

This application is a U.S. National Stage Application of International Application No. PCT/EP2020/078194 filed Oct. 8, 2020, which was published in English on Apr. 15, 2021, as International Publication No. WO 2021/069534 A1. International Application No. PCT/EP2020/078194 claims priority to European Application No. 19202138.4 dated Oct. 9, 2019.

The invention relates to a method and apparatus for shaping a continuous web material into a rod. In particular, it relates to a method and apparatus for shaping continuous web material used in the manufacture of aerosol-generating articles.

Aerosol generating articles or their components such as for example, filter plugs or aerosol-cooling segments may be manufactured from continuous web material, such as cellulose or plastic web. Due to the special materials used for the production of these segments, some processing steps in a processing line may provide additional challenges when handling such webs. For example, some plastic materials, such as, for example, polylactic acid webs, tend to be heated, for example due to friction, upon handling the web. This may lead to irregular folding, for example in a funneling of the web, thereby reducing the reproducibility of the products manufactured from the web.

It is desirable to provide a method and apparatus for shaping continuous web material in the production of aerosol-generating articles.

According to the invention, there is provided a method for shaping a continuous web material into a rod. The method comprises providing a continuous web material having a glass transition temperature below 150 degree Celsius and gathering the continuous web material from a flat shape into a rod-shape by means of a shaping device. The method further comprises providing a cooling means providing a temperature below four degree Celsius, cooling a material contact surface of the shaping device to a surface temperature below four degree Celsius and cooling the continuous gathered web material by the cooled material contact surface in contact with the continuous gathered web material. Preferably, the method comprises cooling the continuous gathered web material to a material temperature of below four degree Celsius, in particular where the web material is in direct contact with the material contact surface.

The cooling means may be any means for cooling a material contact surface to temperatures below four degree Celsius, in particular to below zero degree Celsius. Cooling means may, for example, be a Peltier element or a cooling fluid. Using a cooling fluid is very efficient in cooling. Using a Peltier element is a simple way of cooling without having to handle a fluid.

Preferably, the cooling means is a cooling fluid having a fluid temperature below four degree Celsius, more particular below zero degree Celsius.

Friction between the web material and in particular a stationary shaping device is highest in a final rod forming section of the gathering process (garniture). With an undercooling of the web material a local overheating of the web material due to friction upon gathering in the shaping device may basically be prevented.

Preferably, a local overheating is prevented or at least reduced to a temperature of the web material significantly below its melting temperature. Preferably, an overheating is prevented or reduced to a temperature of the web material significantly below its glass transition temperature.

Preferably, the web material is cooled such that a temperature of the web stays at least 10 degree Celsius below its glass transition temperature. More preferably, a temperature of the web material stays at least 20 degree Celsius, at least 40 degree Celsius, or at least 50 degree Celsius below its glass transition temperature. If a web material has a glass transition temperature for example above 100 degree Celsius, the temperature of said web material preferably stays even more than 50 degree Celsius below its glass transition temperature when cooled. For example, if the web material is cooled to below four degree Celsius upon shaping the web material, the temperature of the web material falls about 100 degree Celsius or even more below its glass transition temperature.

Excess heat may change the specification of a material. By preventing an overheating of materials having low glass transition temperatures or low melting temperatures or both, the materials are prevented from getting tacky or are prevented from partial melting. Thus, it may be prevented that individual folds of such a material stick together or fuse upon gathering. Advantageously, a variation of the resistance to draw (RTD) of a plug formed by the material from an intended value for the resistance to draw is reduced or entirely avoided. This may increase the reproducibility of the production. In addition, a sticking of a partially molten or tacky material to apparatus parts may be avoided. Thus, possible apparatus blockage and displacement may be avoided. Alternatively or in addition, damage to the material may be avoided.

Advantageously, the local overheating of the material is prevented preferably such that the temperature of the web material does not reach the glass transition temperature and more preferably that the temperature does not even get close to the glass transition temperature. Yet further, the tensile strength of the material may be reduced by heating. This in turn may require reducing the machine speed in order to prevent rupture of the material. Machine stops and waste due to rupture of the material with reduced tensile strength can thus be avoided. Preventing or reducing the overheating of the material is therefore particularly advantageous for materials with a low glass transition temperature or low melting temperature, such as for example a web of polylactic acid.

At the glass transition temperature a solid material changes into the rubbery-elastic state and the solid material turns into a pasty melted material. For example, an amorphous or semi-crystalline plastic material may get tacky and may undergo changes in its stability. A transition to the rubbery-elastic state or yield range is continuous. At the glass transition temperature the material does not undergo a phase transition. Thus, the glass transition temperature is not related to an exact temperature but to a temperature range. Such a temperature range may be within a few degree Celsius, for example 5 degree Celsius, or within a few tens degree Celsius, for example plus or minus 20 degree Celsius around a specific glass transition temperature.

It is also known that a continuous material may get brittle and inadvertently break upon handling if cooled to very low temperatures. However, it has been found that a web material when cooled via a cool contact surface does not inadvertently break or only to a very limited extent, compared to cooling via direct contact with a cooling fluid. In addition, cooling via contact with a cooled contact surface has the advantage to cool the web material exactly at the location where friction occurs: at the interface between shaping device and continuous web material gathered in the shaping device.

Yet further, in a final rod-shaping region accuracy requirements with respect to a diameter of the rod are strict. They are difficult to maintain under varying compression strengths of a cooling fluid introduced into a web material but may well be achieved using a cooling surface.

It has also been found that using a cooling means providing a cooling temperature below four degree Celsius, cooling a contact surface below four degree Celsius and with the cooled contact surface also cool the web material, preferably also to a temperature below four degree Celsius, provides very good results in preventing an overheating of web materials having low glass transition temperatures such as for example polylactic acid material upon gathering. It has been found that in particular good results in preventing an overheating of web materials having low glass transition temperatures may be achieved by using cooling means providing a cooling temperature below zero degree Celsius, for example minus 0 degree Celsius to minus five degree Celsius.

It has been found that this measure provides very good results in stationary shaping elements, in particular in stationary funnel shaped shaping devices with productions speeds between about 200 and 500 meters per minute.

Throughout the specification, the term "cooling" is used to refer to an active step to limit, maintain or reduce the temperature of the continuous web material, of sections of the continuous web material or of an element that is in contact with the continuous web material, thus preventing the further increase of temperature of the continuous web material.

The terms "upstream" and "downstream" are used herein in view of the transport direction of the continuous web material in an apparatus or in individual elements of an apparatus performing the method, wherein downstream is in the direction of production.

As a general rule, whenever the term "about" is used in connection with a particular value throughout this application this is to be understood such that the value following the term "about" does not have to be exactly the particular value due to technical considerations. However, the term "about" used in connection with a particular value is always to be understood to include and also to explicitly disclose the particular value following the term "about".

The term "gathering" is used throughout the specification to refer to a reduction in a width of the continuous web material. By the gathering the continuous material is reduced in a lateral direction of the material, thus transversal to the longitudinal and transport direction of the material. A gathering may, for example, be a compression, a funneling and a rod-shaping of the material or combinations of the aforementioned processes. A gathering includes a reduction in width of the continuous web material by, for example, a simple pushing the sides of the continuous material versus a longitudinal central axis of the continuous material.

A gathering may be performed continuously or step-wise. A gathering may be performed in one or in several portions of a shaping device.

A gathered material as used herein may be a partially gathered material or a final gathered material. Partially gathered material has a reduced width compared to the continuous web material as supplied to an apparatus performing the method according to the invention. Partially gathered material may also have a reduced width compared to a partially gathered material that has already passed a previous portion of the shaping device. Partially gathered material has a larger width than the width of a final rod shape of the continuous material. Frequently, a reduction in width of the web material leads to increase in height of the gathered material.

Preferably gathering includes the formation of longitudinal folds forming channels in the longitudinal direction of the gathered web material.

It may be advantageous that web material is crimped before gathering. In particular, the crimping may improve control over the way the web material is gathered. Crimping is a process in which corrugations are introduced into the web material. The crimping depth of the corrugations may be varied, and may be quantified as an amplitude of corrugation.

Preferably, a crimped web material has an amplitude of corrugation, or crimping depth, of between 50 micrometres and 300 micrometres, more preferably between about 100 and about 250 micrometres.

The cooling of the continuous web material in the shaping device via a cooled contact surface also supports the gathering or shaping step. The material contact surface is part of the shaping device and comprises a shape for shaping the continuous web material according to this shape or for retaining the continuous web material in a specific shape.

In a step-wise gathering process, the web material is gathered to a specific rod diameter in a first step. In a further gathering step the web material is gathered to smaller rod diameters down to a final diameter.

A final rod shape may have an external diameter of between 5 millimeter and 12 millimeter, preferably between 6 millimeter and 10 millimeter.

Preferably, a rod manufactured with the method of the present invention has a circular or elliptic cross section.

Preferably, the method comprises a step-wise gathering of the continuous web material into the rod shape. Preferably, the method comprises in a first gathering step gathering the continuous web material from the flat shape to a rod shape having a first diameter. In a second gathering step the method may comprise further gathering the continuous web material from the rod shape having the first diameter to a final rod shape having a final diameter, wherein the final diameter is smaller than the first diameter.

In preferred embodiment a first diameter is in a range of 2 centimeter to 5 centimeter.

In preferred embodiments, a final diameter is at most 12 millimeter.

Most heat is produced when the continuous web material is compressed most, thus when the web material is compressed to its final rod diameter. The continuous web material may be cooled during the first and during the second gathering step. Preferably, the continuous web material is cooled at least during the second gathering step and may be cooled during the second gathering step only. The cooling of the material contact surface is achieved by the provision of a cooling means in thermal contact with the shaping device. Preferably, the cooling of the material contact surface is achieved by the provision of a cooling fluid into or through the shaping device. A cooling fluid may for example be a cooling liquid, such as for example a mixture of water and glycol. Preferably, a mixture of about 50 percent water and about 50 percent glycol is used as cooling fluid.

In operation, the cooling means provide a cooling temperature of below four degree Celsius. The cooling means may provide a cooling temperature below 2 degree Celsius, zero degree Celsius, below minus 2 degree Celsius, below minus 4 degree Celsius, below minus 6 degree Celsius, below minus 8 degree Celsius, below minus 10 degree Celsius, below minus 20 degree Celsius. Preferably, the cooling temperature is in a range between three degree Celsius and minus 45 degree Celsius, preferably between three degree Celsius and minus 20 degree Celsius, more preferably, between zero degree Celsius and minus 10 degree Celsius.

When using a cooling fluid, the cooling fluid has a fluid temperature of below four degree Celsius. The cooling fluid may have a cooling temperature below 2 degree Celsius, zero degree Celsius, below minus 2 degree Celsius, below minus 4 degree Celsius, below minus 6 degree Celsius, below minus 8 degree Celsius, below minus 10 degree Celsius, below minus 15 degree Celsius, below minus 20 degree Celsius or below minus 20 degree Celsius. Preferably, the fluid temperature is in a range between three degree Celsius and minus 30 degree Celsius, preferably between three degree Celsius and minus 20 degree Celsius, more preferably, between zero degree Celsius and minus 15 degree Celsius.

A surface temperature of the material contact surface is below four degree Celsius. The surface temperature of the material contact surface may be below 2 degree Celsius, zero degree Celsius, below minus 2 degree Celsius, below minus 4 degree Celsius, below minus 6 degree Celsius, below minus 8 degree Celsius, below minus 10 degree Celsius, below minus 15 degree Celsius, below minus 20 degree Celsius or below minus 25 degree Celsius. Preferably, the surface temperature of the material contact surface is in a range between four degree Celsius and minus 25 degree Celsius, preferably between four degree Celsius and minus 20 degree Celsius, more preferably between zero degree Celsius and minus 15 degree Celsius, for example the surface temperature is about minus 5 degree Celsius.

Preferably, the web material is cooled to a material temperature below four degree Celsius. The web material may be cooled to a temperature between minus 30 degree Celsius and four degree Celsius, between minus 20 degree Celsius and four degree Celsius or between minus 10 degree Celsius and zero degree Celsius.

Preferably, a surface temperature of a contact surface is controlled to be at a lower temperature, the higher a velocity of a web material passing the contact surface is.

Preferably, the method comprises the further step of measuring a cooling temperature of a cooling means, for example of a cooling fluid.

The method may further comprise the step of providing a funnel to gather the web material. The funnel may comprise a cooling finger that contacts the web material in the area of highest compression. The cooling finger may comprise a reservoir for a cooling fluid. Providing a reservoir for a cooling fluid may advantageously increase the thermal capacity of the cooling finger, in particular, where the reservoir is filled with a cooling fluid. The cooling effect may further be improved by circulating or continuously (or alternatively discontinuously) exchanging the cooling fluid in the reservoir.

The method may further comprise the step of providing a cooling bar. The cooling bar may be in contact with the gathered rod after the cooling funnel.

The step of measuring the temperature may be performed at or inside the reservoir. The step of measuring the temperature may be performed at the cooling bar. Preferably, the method comprises the step of cooling the fluid in the reservoir to a temperature of between plus 4 degrees Celsius and minus 10 degrees Celsius. Preferably, the method comprises the step of cooling the fluid at the end of the cooling bar to a temperature of between plus 4 degrees Celsius and minus 10 degrees Celsius.

Exact measurement of a material temperature of the continuous web material is difficult. As the gathering and generation of frictional heat may be a fast changing process, measurement of material temperature is often not very precise, in particular in view of local material temperatures. For example, in an almost finally gathered rod of continuous web material there may exist large temperature differences between a center of the rod and locations on the periphery of the rod.

Therefore, preferably, a surface temperature of a cooled contact surface is measured. Preferably, the surface temperature of a cooled contact surface is measured in operation, thus, preferably during performing the method according to the invention or in operation of the apparatus according to the invention. Preferably, the surface temperature of a cooled contact surface is measured while a continuous web material passes and contacts the cooled contact surface. By measuring and controlling the surface temperature of a contact surface, the material temperature of the gathered continuous web material may be controlled upon defined material parameters and process parameters. Preferably, a surface temperature of a cooled contact surface is measured at different locations during the shaping process, for example at different locations of a shaping device.

The method may further comprise:

wrapping the rod-shaped continuous gathered web material with a continuous strip of wrapping material provided with adhesive;

cooling a rod contact surface of a rod cooling device with the cooling means to a rod contact surface temperature below four degree Celsius and contacting the wrapped rod of continuous gathered web material with the cooled rod contact surface;

thereby cooling the wrapping material provided with adhesive and wrapped around the rod of continuous gathered web material by the cooled rod contact surface in contact with the wrapped rod. Preferably, the wrapping material wrapped around the gathered web material is cooled to a wrapper temperature below four degree Celsius.

After the continuous web material has been gathered into its final rod shape, the rod proceeds to the wrapping stage. There, a wrapping material provided with an adhesive is closed on itself wrapping the web material and forming a wrapped continuous rod of web material.

A wrapper material for wrapping a gathered web material is provided with adhesive at least along a seam to close the wrapper around the web material. Such adhesive may be heated and then applied to the wrapper material when being hot. Alternatively or in addition, the wrapper material may be provided with adhesive, which adhesive is liquefied upon heating the wrapper material comprising the adhesive. Irrespective of an application process, heat is supplied to the wrapped rod of web material. It has been found that the heat supplied upon wrapping a rod may have the same negative effects on the web material as outlined above with respect to heat generated by friction. This particularly applies to web materials having a low glass transition temperature or a low melting temperature. Thus, preferably, the heat provided upon wrapping the web material is limited or it has to be avoided that the heat proceeds into the temperature sensitive web material. It has been found that conventional cooling of the wrapped rod, for example by air may stabilize adhesive on a wrapping material but may not prevent the heat to penetrate into the web material. In particular it has been found that the effect of the heated adhesive onto the web material may be reduced or even avoided, when the wrapped rod is cooled by using a cooling means providing a temperature below four degree Celsius. In particular, the wrapped rod may be cooled by the contact of a rod contact surface having a rod contact surface temperature of below four degree Celsius.

Preferably, the wrapper is cooled to a wrapper temperature below four degree Celsius. The wrapper may, for example, be cooled to a temperature between minus 30 degree Celsius and four degree Celsius, between minus 20 degree Celsius and four degree Celsius or between minus 10 degree Celsius and zero degree Celsius.

By undercooling the continuous web material during gathering as well as undercooling the wrapped rod of web material after the wrapping material has been wrapped and closed around the rod, the reproducibility of manufactured continuous rods of web material may be improved. Material parameters may be kept constant or within small variations and a melting together of material may be prevented or strongly limited during gathering and wrapping.

According to the invention, there is also provided an apparatus for shaping a continuous web material into a rod. The apparatus comprises a shaping device for shaping a continuous web material from a flat shape into a rod shape. The shaping device comprises a funnel portion for giving the continuous web material a rod shape. The shaping device comprises a material contact surface for contacting the continuous web material guidable through the funnel portion. The apparatus also comprises cooling means for providing a cooling temperature below four degree Celsius. The shaping device is in connection with the cooling means and is adapted for cooling the material contact surface of the shaping device to a surface temperature below four degree Celsius. Therein the material contact surface is arranged along the length of the funnel portion of the shaping device to cool the continuous web material while being gathered in the funnel portion.

Preferably, the cooling means is a source of cooling fluid having a temperature below four degree Celsius. In these embodiments the shaping device is in fluid connection with the source of cooling fluid.

Preferably, the apparatus comprises a wrapping device for wrapping the rod-shaped web material with a continuous strip of wrapping material. The wrapping material is provided with adhesive.

Preferably, the apparatus comprises a rod cooling device comprising a rod contact surface for contacting the wrapped rod of web material. The rod cooling device is adapted for cooling the rod contact surface of the wrapping device to a rod contact surface temperature below four degree Celsius. Thereby the wrapping material wrapped around the rod of web material is cooled to a wrapper temperature, preferably to a wrapper temperature of below four degree Celsius.

For cooling the rod contact surface, the rod cooling device is in connection with a cooling means providing a cooling temperature below four degree Celsius. Preferably, for cooling the rod contact surface, the rod cooling device is in fluid connection with a source of cooling fluid having a fluid temperature below four degree Celsius.

Same cooling means providing a cooling temperature below four degree Celsius may be used for cooling the shaping device and for cooling the rod cooling device. Separate cooling means may be used for the shaping device and for the rod cooling device. Separate cooling means may, for example, provide different temperatures or be based on different ways of cooling such as for example a cooling means in the form of a Peltier element or using a cooling fluid.

For example, a same source of cooling fluid having a fluid temperature below four degree Celsius may be used for cooling the shaping device and for cooling the rod cooling device. Separate sources of cooling fluid may be used for the shaping device and for the rod cooling device. Separate sources of cooling fluid may, for example, comprise cooling fluids having different temperatures or different fluid composition.

Advantages of the apparatus for undercooling a web material while the web is being gathered and formed into a rod, preferably also being undercooled after having been formed into a rod and wrapped has been described in connection with the method according to the invention and will not be repeated.

Gathering the continuous web material from a flat into a rod shape preferably comprises successively gathering the continuous web material in a direction perpendicular to a transport direction of the continuous web material. Such a gathering is preferably done by a stationary shaping device. This is a particular simple way of gathering web material compared to, for example, using moving shaping devices.

Preferably the shaping device comprises a funnel portion, wherein at least a part of the funnel portion comprises an upper funnel part and a lower transport plane comprising a longitudinally extending converging groove.

The upper funnel part and the lower transport plane together may form the shaping device. The upper funnel part and the lower transport plane may also at least partly form the shaping element. Thus, further shaping elements may be provided to form the shaping device, for example an extra funnel portion or a crimping device arranged upstream of the shaping device. An extra funnel portion may, for example, be a metallic funnel. Preferably, the funnel is coated or consists of an anti-friction material.

In some embodiments the upper funnel part forms a half of the shaping device, for example an upper half. In these embodiments, the lower transport plane forms the other half of the shaping device, for example a lower half of the shaping device.

The upper funnel part gives a portion of the continuous web material a concave circumferential shape. The lower transport plane or groove extending in the transport plane, closes the funnel portion along the remaining circumference, such that the continuous material is guided within the shaping device.

Preferably, the funnel portion has an inner concave shape for giving the continuous web material a circular or oval circumferential shape. In particular, the material contact surface of the shaping device, more particularly the upper funnel part may have a concave shape. Preferably, the material contact surface of the shaping device has a converging concave shape converging in transport direction of web material.

Preferably, a surface temperature of the material contact surface is measured at one, more preferably at two or more locations of the contact surface.

A funnel, preferably an extra funnel portion arranged upstream of the shaping device comprising the cooled contact surface, comprises a structure surface. The structure may reduce a direct contact of the funnel surface with the web material passing the funnel. This may reduce generation of frictional heat. The structure may also lessen a cooling action of the funnel to the web material.

Preferably, a surface structure of a funnel is chosen such that a contact or non-contact of the continuous web material with the structured surface of the funnel changes as the web material passes the funnel. Preferably, the structure is chosen such that the same portion of the web material passing the structured surface of the funnel is neither in constant contact nor permanently not in contact with the structures of the structured surface of the funnel.

The structure may be a regular structure or a random structure. The structure may, for example, be a wavy line structure, diverging or converging line structure, a dimple structure where dimples are preferably arranged in a sideways displaced manner when seen along a transport direction of the web material.

The transport plane of the shaping device may serve to support a continuous strip of wrapping material. The shaping method preferably comprises the step of guiding a continuous strip of wrapping material along a transport plane of the shaping device.

The continuous web material may be arranged on the wrapping material and may be transported on the wrapping material in a downstream transport direction. Preferably, the groove in the transport plane is of a concave shape, which converges in a transverse direction. The groove may extend along the entire length or only along a part of the length of the transport plane.

The wrapping material forms an inner liner of the groove partially wrapping the continuously gathered web material. After the continuous web material has been gathered to its final rod shape, the wrapping material is entirely wrapped around the rod, fixing the rod in its rod shape. Such a continuous or merged rod forming and wrapping is particularly favorable with resilient web materials tending to resist gathering, such as for example many kind of plastic foils.

Advantageously, the rod cooling device is arranged downstream of the shaping device and downstream of the wrapping device. The rod cooling device may also be integrated into a wrapping device or wrapping element such that cooling of the wrapping material may occur simultaneously with the wrapping or immediately after the wrapping.

Preferably, the rod contact surface of the rod cooling device has a concave shape. Preferably, the shape of the rod contact surface is constant over a length of the rod cooling device.

Preferably, the part of the rod cooling device comprising the rod contact surface is removably mounted above the transport plane. This allows to observe the wrapping process. Preferably, the rod contact surface is in contact with the wrapping material. Preferably, the rod contact surface is at least in thermal contact with thermally conductive parts of the rod cooling device, preferably, the rod contact surface is in thermal contact with thermally conductive parts of the wrapping device.

A rod contact surface extends along a longitudinal extension of the rod or along a transport direction. The rod contact surface may have a length in transport direction of the web material of about 10 centimeter to about 80 centimeter, preferably, about 30 centimeter to 60 centimeter.

Preferably, a temperature of the rod contact surface is measured at one, more preferably at two or more locations along the length of the of the rod contact surface.

A material contact surface extends along the funnel portion in transport direction of the web material. A material contact surface may extend from an upstream end of the funnel portion to a downstream end of the funnel portion. In particular, a material contact surface may extend from an upstream end of an upper funnel part to a downstream end of the upper funnel part. By this, an undercooling of the continuous web material occurs in that gathering section where most friction occurs and most heat due to frictional forces is generated. A material contact surface may extend from a most upstream end of the shaping device to a most downstream end of the shaping device. By this, the web material may be cooled during a gathering from a flat to a final rod shape.

A material contact surface and a rod contact surface extend at least along a part of the circumference or periphery of the gathered web material or of the rod. A contact surface may extend between about 90 degree and 360 degree along the circumference of the web material. Thus a cooled contact surface may partly or entirely surround the web material. Preferably, a contact surface extends at least about 90 degrees along the circumference of the web material. More preferably, a contact surface extends at least about 180 degree along the circumference of the web material. Preferably, contact surfaces are cooled via thermal contact with a cooling means, preferably a cooling fluid.

Actively cooled parts of the apparatus are in thermal contact with other parts of the apparatus, such that contact surfaces may be cooled via thermal contact with actively cooled parts of the apparatus.

Preferably, an actively cooled upper funnel portion is in thermal contact with a transport plane. A groove in the transport plane serving as lower contact surface for a web material, possibly via a strip of wrapping material arranged underneath the web material, may be cooled via thermal contact with the upper funnel portion. By this a 360 degree cooling contact surface is available for the web material being gathered between upper funnel portion and lower transport plane.

Preferably, apparatus parts in thermal contact with a contact surface are made of good thermal conductors, for example metal. Preferably, thermally conducting materials used for a cooling element or connecting parts of cooling elements and contact surfaces have a thermal conductivity of at least 10 W/mK. Preferably, thermal conductive materials used for cooling the web material in the apparatus of the present invention have a thermal conductivity of at least 200 W/mK.

A continuous web material as used herein is, for example, a web of material that is used in the manufacture of aerosol generating articles, for example for electronic smoking devices. Preferably, the continuous web material is a plastic web, for example a continuous web of polylactic acid. The continuous web material may be an aerosol-forming substrate.

In some embodiments, the continuous web material may be soaked or impregnated with an aerosol-forming material. The continuous web material as such may then be a non-aerosol-forming substrate. The soaking or impregnation may be performed before crimping, before gathering or during gathering of the continuous web material. Preferably upon heating the aerosol-forming substrate or upon heating the continuous web material soaked or impregnated with an aerosol-forming material, a substance is released from the substrate or from the web material, which substance may form an inhalable aerosol.

Preferably, the continuous web material is formed into an endless rod for future manufacture of individual plugs. Upon rod forming, a susceptor may be inserted in the rod. For example a susceptor strip may be inserted into the continuous web material during gathering of the web material. By this, inductively heatable rods or plugs may be manufactured.

Preferably, the continuous web material has been pretreated before being formed in the apparatus according to the invention. A pretreatment is, for example, a crimping or embossing or both.

Preferably, the method comprises providing a crimped continuous web material having longitudinally arranged crimps. The crimps are arranged in a transport direction of the web material. Upon gathering the continuous web material forms longitudinal channels along the crimps. The longitudinal channels define a resistance to draw of an article formed by the gathered web material or comprising a plug of gathered web material. Preventing merging of such longitudinal channels by a melting of the web material upon gathering allows to achieve a reproducibility of a resistance to draw of the gathered web material. Preventing merging of longitudinal channels is in particular advantageous when using an otherwise substantially gas impermeable web material.

The continuous web material used in the method according to the invention has a glass transition temperature of below 150 degree Celsius. Preferably, the continuous web material has a glass transition temperature below 100 degree Celsius. Since a glass transition temperature is below a melting temperature, the continuous web material also has a melting temperature, which is preferably around 150 degree Celsius or lower. Since glass transition temperatures refer to ranges rather than exact temperatures, a glass transition temperature preferably comprises plus or minus 20 degree Celsius around a specific glass temperature, more preferably, plus or minus 5 degree Celsius around the specific glass transition temperature.

Preferably, the continuous web material has a porosity of less than about 5 percent, preferably of less than about 2 percent. Most preferably, the continuous web material is gas impermeable, for example air impermeable.

Preferably, a material used to form a continuous rod has low porosity or substantially no porosity.

Porosity is defined herein as a measure of pores or openings extending through the web material. For example, if the web material comprised openings or pores adding up to 50 percent of the web area, then the porosity would be 50 percent. Likewise, a web material has a porosity of 0 percent if the web material was completely dense having no pores extending through the web. The porosity may be measured or calculated using known methods.

The rod may, for example, be formed from a web material such as for example a polymeric web or a web material selected from the group consisting of polyethylene (with a glass transition temperature between about minus 130 degrees Celsius and about minus 80 degrees Celsius; melting temperature between about 115 and about 130 degrees Celsius), polypropylene (with a glass transition temperature between about minus 20 degrees Celsius and about zero degrees Celsius; melting temperature between about 130 degrees Celsius and about 170 degrees Celsius), polyvinylchloride (with a glass transition temperature between about 60 degrees Celsius and about 87 degrees Celsius; melting temperature between about 160 degrees Celsius and about 260 degrees Celsius), polyethylene terephthalate (with a glass transition temperature at about 70 degrees Celsius; melting temperature below about 250 degrees Celsius), polylactic acid (with a glass transition temperature between about 50 degrees Celsius and about 65 degrees Celsius; melting temperature of about 155 degrees Celsius), cellulose acetate (with a glass transition temperature between about 100 degrees Celsius and about 130 degrees Celsius; melting temperature between about 170 degrees Celsius and about 240 degrees Celsius).

The apparatus and method according to the invention are in particular suited for materials having a low glass transition temperature. The continuous web material formed in the apparatus and according to the invention has a glass transition temperature of below 150 degree Celsius, for example below 100 degree Celsius. Preferably, the continuous web material is a plastics material, for example polylactic acid. The continuous material may be a crimped continuous web material.

Figure 2:
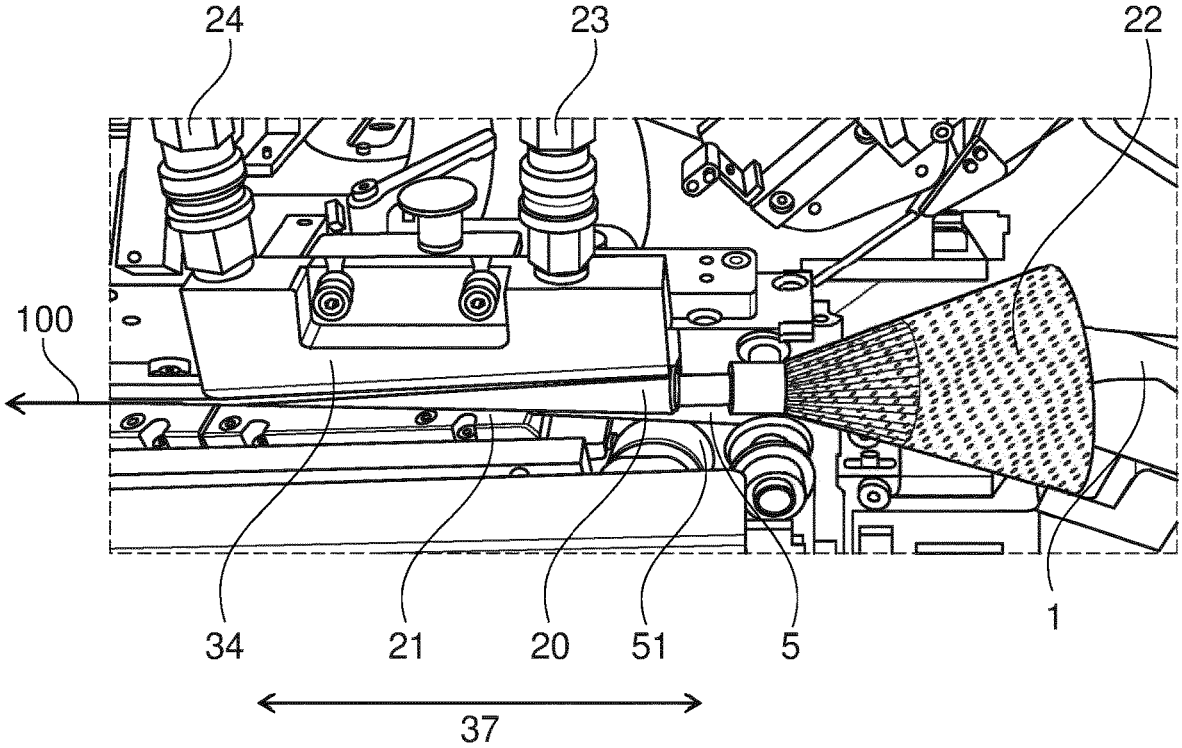
Figure 3:
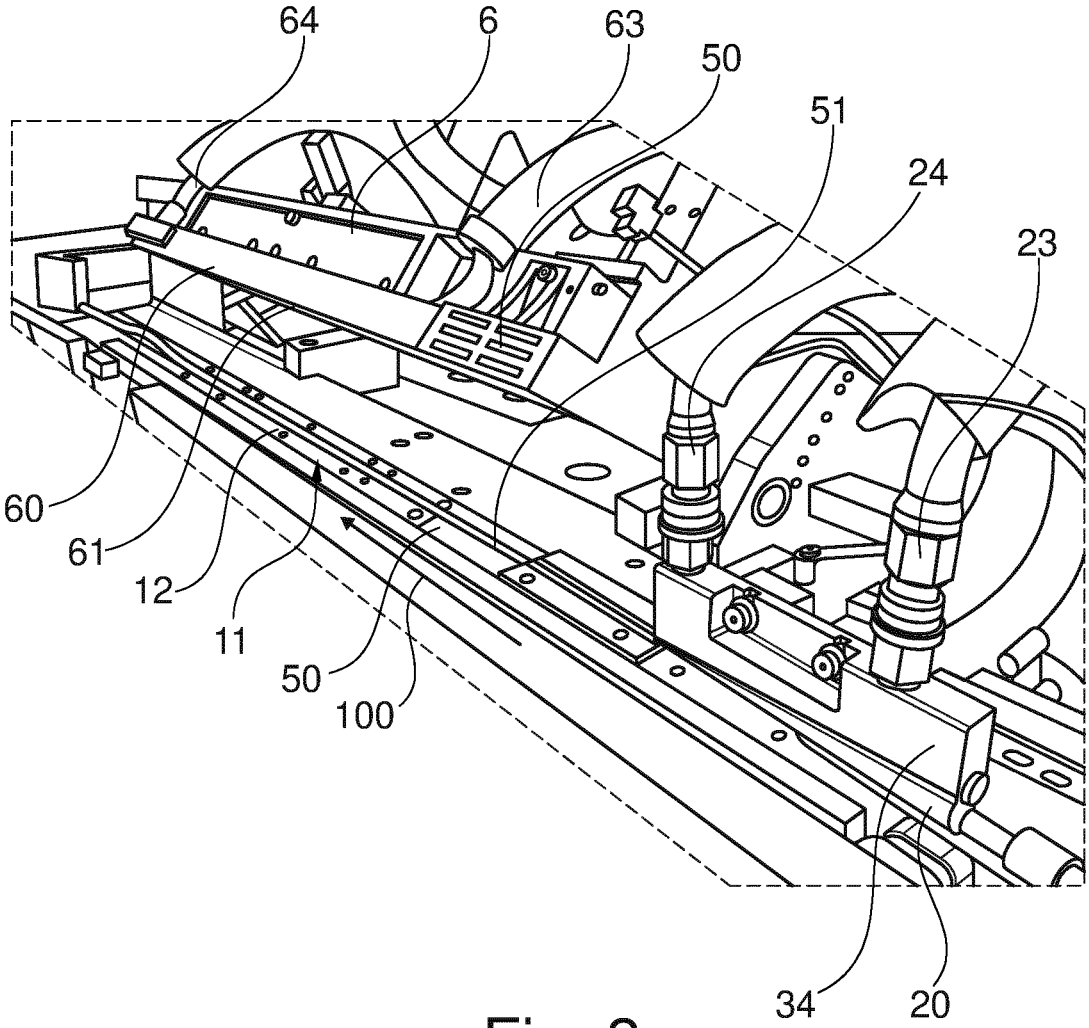

The invention is further described with regard to embodiments, which are illustrated by means of the following drawings, wherein:

FIG. 1: is a schematic drawing of a funnel stage of a rod manufacturing process;

FIG. 2: shows a shaping and cooling device;

FIG. 3: shows the apparatus of FIG. 2 with a rod cooling device.

In the manufacturing process schematically shown in FIG. 1 and in the apparatus shown in FIG. 2, a continuous web material 1, for example polylactic acid, is unwound from a storage bobbin (not shown). The web of polylactic acid is preferably conveyed through different processes, for example a crimping process up to a shaping process in the shaping device 2, where the web material 1 is gathered and compressed into a continuous rod.

The web material 1 enters inside the half-funnel of an upper shaping element 20 in the processing and transport direction indicated by arrow 100.

The rod-shaping is performed via the upper shaping element 20 and the lower closing element 21. The upper shaping element 20 is arranged opposite the closing element 21. The shaping element 20 is a half-funnel and shapes the web material 1 from the top. The closing element 21 is a transport plane comprising a groove, where a wrapping material, for example wrapping paper 5, is guided in the groove for wrapping the rod-shaped web material 1 along the web material. On the bottom of the shaping device 2, along the transport plane, the web material 1 comes in contact with the wrapping paper 5 also moving along transport direction 100 at the same speed as the web material 1. The wrapping paper 5 is put on a garniture tape 51 that pulls the wrapping paper 5. By this, also the web material 1 is pulled into and through the funnel of the shaping device 2.

The groove in the transport plane of the closing element 21 typically takes a progressive concave shape that supports compressing and shaping the web material 1. Downstream of the shaping device 2, the wrapping paper is folded and closed on itself, forming a continuous cylindrical wrapped rod, preferably a polylactic acid rod wrapped in paper. The rod may subsequently be cut into individual plugs thereby generating a component or segment used in the manufacturing process of an aerosol-generating article.

At a transport speed of between about 200 meters per minute and about 500 meters per minute, substantial friction between the web material 1 and the preferably metallic but stationary shaping device 2 occurs. In regions where the web material is most compressed the web material is heated up most. This is indicated in FIG. 1 by lines 200.

As shown in FIG. 2, the web material is slightly gathered in an upstream funnel 22. The upstream funnel 22 is made of a metal with structured surface to reduce the contact between the web material 1 and the surface of the upstream funnel 22.

The structure of the funnel surface is a dimple structure wherein dimples are arranged sideways displaced to each other when seen along a transport direction of the web material. By this, the web material 1 is in non-continuous contact with the wall of the upstream funnel 22 when passing the upper funnel 22.

In addition, the material of the upstream funnel 22 is an anti-friction material or provided with an anti-friction coating.

In order to avoid a friction related overheating of the web material 1 above its glass transition temperature or above its melting temperature, the contact surface of the upper funnel portion 20 is cooled.

The contact surface is cooled to a temperature below zero degree Celsius by using a cooling fluid having a temperature below zero degree Celsius. For example the cooling fluid as well as the contact surface of the half funnel portion 20 has a temperature of about minus five degree Celsius. Preferably, the cooling fluid is a mixture of 50 percent water and 50 percent glycol.

A cooling element 34 is arranged above the upper half funnel 20. The cooling element 34 is cooled via the cooling fluid circulating through a cooling fluid circuit in the cooling element 34. The cooling element 34 is in direct contact with the upper half funnel 20 and may be manufactured in one piece with the upper half funnel 34. The cooling element 34 keeps the wall of the funnel at a temperature below zero degree Celsius. Via direct contact of the web material 1 with the wall of the funnel, the web material is cooled via the contact surface of the funnel wall. The cooling element is partially hollow, creating an interior reservoir of about 100 millilitre.

The cooling fluid is introduced via a fluid inlet 23 into an upstream portion of the cooling element 34 and passes inside along the cooling element 34. The cooling fluid leaves the cooling element 34 at a fluid outlet 24 at a downstream end of the cooling element. The cooling element 34, where the cooling fluid passes through, is in thermal contact with the upper half funnel 20 and with the contact surface of the upper half funnel. The cooling element 34 as well as the upper half funnel is made of a thermally conductive material, for example metal such as copper.

Preferably, the closing element 21, in particular the transport plane comprising the groove is in thermal contact with the cooled upper half funnel 20. Through this thermal contact also a lower side of the continuous web material 1 passing the shaping device 2 is indirectly cooled by the cooling element 34. Preferably, the closing element 21 is made of a thermally conductive material such as for example metal, to support thermal transfer of cold from the cooling element 34 to the groove in the transport plane.

The contact surface has a concave shape converging versus the downstream end of the contact surface and of the upper half funnel 20. Thus, the web material 1 is gathered and formed to a rod shape in the shaping device, and is thereby constantly cooled by the contact surface having temperatures below zero degree Celsius. Thus the temperature of the web material is kept well below its melting temperature and well below its glass transition temperature.

Preferably, the web material itself is cooled down to temperatures below four degree Celsius. For a web of polylactic acid, the temperature of the material is preferably kept below 30 degrees Celsius. Preferably, this is achieved by lowering the temperature of the cooling fluid in the reservoir of the cooling element 34 to about minus 5 degrees Celsius.

Examples of a length 37 over which the web material is cooled while being in direct contact with the cooled contact surface of the shaping device 2 are about 0.05 meter and 0.5 meter. Preferably, this length corresponds to the length of the upper half funnel 20 of the shaping element.

In FIG. 3 a part of the shaping device 2 of FIG. 2 may be seen as well as the downstream arranged wrapping part and a rod cooling device 6.

A web material 1 shaped into a rod in the shaping device is completely wrapped with wrapping paper in the rod forming device 50. In the rod forming device 50, wrapping material 5 is provided with a seam of glue and closed on itself thereby forming a wrapped rod of web material.

The rod cooling device 6 is arranged immediately downstream of the wrapping device. The rod cooling device 6 comprises a longitudinal body 60 arranged above the transport plane 11 and above the groove 12 where the wrapped rod of web material is guided in.

The body 60 of the rod cooling device 6 comprises a cooling fluid inlet 63 at its upstream end and a cooling fluid outlet 64 at its downstream end. Preferably, the cooling fluid is the same as the cooling fluid used for cooling the shaping device 2. The cooling fluid for cooling the wrapped rod has a temperature below zero degree Celsius, for example about minus five degree Celsius. The cooling fluid passes through the rod cooling device 6 and cools the rod cooling contact surface 61 of the rod cooling device 6 to a temperature below zero degree Celsius.

The rod contact surface extends along the body 60 and preferably has a concave shape such as to neatly contact a wrapped rod of web material passing underneath the rod contact surface 61.

The rod cooling device 6 or at least the body 60 with the rod contact surface 61 is rotatable around an arm such as to be lifted from a cooling position into a retracted position. In the cooling position, the rod cooling device 6 basically forms a roof over the garniture tape 51 guided along the transport plane 11. In FIG. 3 the rod cooling device 6 is shown in the retracted position. In the retracted position, the rod cooling device 6 allows free access and view onto a wrapping process and the rod cooling part of the manufacturing process.

The invention claimed is:

1. A method for shaping a continuous web material into a rod, the method comprising:

providing a continuous web material comprising a material having a glass transition temperature below 150 degree Celsius;

gathering the continuous web material from a flat shape into a rod-shape by means of a shaping device;

providing a cooling means providing a temperature below four degree Celsius and cooling a material contact surface of the shaping device to a surface temperature below four degree Celsius; and cooling the gathered continuous web material by the cooled material contact surface in contact with the gathered continuous web material.

2. The method according to claim 1, further comprising:

cooling the gathered continuous web material to a material temperature of below four degree Celsius.

3. The method according to claim 1, wherein the cooling means is a cooling fluid.

4. The method according to claim 1, wherein the cooling means provides a cooling temperature between three degree Celsius and minus 45 degree Celsius.

5. The method according to claim 1, wherein the surface temperature of the material contact surface is between three degree Celsius and minus 45 degree Celsius.

6. The method according to claim 1, further comprising guiding a continuous strip of wrapping material along a transport plane of the shaping device.

7. The method according to claim 1, comprising a stepwise gathering of the continuous web material into the rod shape, therein in a first gathering step gathering the continuous web material from the flat shape to a rod shape having a first diameter; and in a second gathering step further gathering the continuous web material from the rod shape having the first diameter to a final rod shape having a final diameter smaller than the first diameter.

8. The method according to claim 1, further comprising:

wrapping the gathered continuous web material with a continuous strip of wrapping material provided with adhesive;

cooling a rod contact surface of a rod cooling device with the cooling means to a rod contact surface temperature below four degree Celsius and contacting the wrapped rod of gathered continuous web material with the cooled rod contact surface; and thereby cooling the wrapping material provided with adhesive and wrapped around the rod of gathered continuous web material by the cooled rod contact surface in contact with the wrapped rod.

9. The method according to claim 1, wherein the continuous web material has a glass transition temperature below 100 degree Celsius.

10. The method according to claim 1, wherein the continuous web material is a plastic material.

11. The method according to claim 1, wherein the continuous web material comprises a polymeric material having a glass transition temperature below 150 degree Celsius.

12. The method according to claim 3, wherein the cooling fluid is a mixture of water and glycol.

13. The method according to claim 4, wherein the cooling means provides a cooling temperature between zero degree Celsius and minus 20 degree Celsius.

14. The method according to claim 5, wherein the surface temperature of the material contact surface is between zero degree Celsius and minus 20 degree Celsius.

15. The method according to claim 10, wherein the continuous web material is polylactic acid.

* * * * *